US010173230B2

(12) United States Patent
Carpanese

(10) Patent No.: US 10,173,230 B2
(45) Date of Patent: Jan. 8, 2019

(54) FOAM GENERATING DEVICE FOR A HIGH-PRESSURE WATER GUN

(71) Applicant: MTM HYDRO S.R.L., Cherasco (IT)

(72) Inventor: Claudio Carpanese, Rovolon (IT)

(73) Assignee: MTM HYDRO S.R.L., Cherasco (IT)

( * ) Notice: Subject to any disclaimer, the term of this patent is extended or adjusted under 35 U.S.C. 154(b) by 0 days.

(21) Appl. No.: 15/506,603

(22) PCT Filed: Sep. 11, 2015

(86) PCT No.: PCT/IB2015/056981
§ 371 (c)(1),
(2) Date: Feb. 24, 2017

(87) PCT Pub. No.: WO2016/038578
PCT Pub. Date: Mar. 17, 2016

(65) Prior Publication Data

US 2017/0259281 A1 Sep. 14, 2017

(30) Foreign Application Priority Data

Sep. 11, 2014 (IT) ..... TO2014A0714

(51) Int. Cl.
*B05B 7/00* (2006.01)
*B05B 15/68* (2018.01)
(Continued)

(52) U.S. Cl.
CPC ..... *B05B 7/005* (2013.01); *B01F 3/04446* (2013.01); *B01F 5/043* (2013.01);
(Continued)

(58) Field of Classification Search
CPC ..... B05B 7/005; B05B 7/2424; B05B 15/68; B05B 15/40; B05B 1/04; B05B 1/12;
(Continued)

(56) References Cited

U.S. PATENT DOCUMENTS

| | | | | |
|---|---|---|---|---|
| 7,566,013 | B2 * | 7/2009 | MacLean-Blevins | B05B 7/12 239/310 |
| 2005/0093297 | A1 | 5/2005 | Gilpatrick | |
| 2005/0155972 | A1 * | 7/2005 | Ray | B05B 1/12 220/694 |

FOREIGN PATENT DOCUMENTS

| | | |
|---|---|---|
| EP | 0 813 918 | 12/1997 |
| EP | 1 852 190 | 11/2007 |
| WO | WO 2012/025425 | 3/2012 |

* cited by examiner

*Primary Examiner* — Christopher Kim
(74) *Attorney, Agent, or Firm* — Leason Ellis LLP

(57) ABSTRACT

A foam generating device for a high-pressure water gun has a supporting body defining part of a conduit, which extends along an axis and has a mixing chamber communicating with a lower inlet, and subject, in use, to a vacuum to aspirate a liquid from said lower inlet; the device has a first sleeve which is fitted around one end of the supporting body, is axially fixed, is rotatable and is provided with an end portion carrying a nozzle; such a nozzle defines the outlet of the conduit and is adjustable so as to vary the outgoing flow type between a fan-like jet and a solid stream jet; the device has, in addition, a second sleeve which is coupled to the first sleeve in a fixed axial position and in a rotatable manner and is provided with cams to adjust the nozzle in response to a rotation of the second sleeve with respect to the first sleeve.

18 Claims, 3 Drawing Sheets

(51) Int. Cl.

| | |
|---|---|
| ***B05B 15/40*** | (2018.01) |
| ***B05B 1/04*** | (2006.01) |
| ***B05B 1/12*** | (2006.01) |
| ***B05B 1/26*** | (2006.01) |
| ***B05B 7/02*** | (2006.01) |
| ***B05B 7/04*** | (2006.01) |
| ***B05B 7/24*** | (2006.01) |
| ***B08B 3/02*** | (2006.01) |
| ***B08B 3/00*** | (2006.01) |
| ***B01F 5/04*** | (2006.01) |
| ***B01F 3/04*** | (2006.01) |

(52) U.S. Cl.

CPC ..... *B01F 5/0411* (2013.01); *B01F 5/0496* (2013.01); *B05B 1/04* (2013.01); *B05B 1/12* (2013.01); *B05B 1/26* (2013.01); *B05B 7/025* (2013.01); *B05B 7/0425* (2013.01); *B05B 7/2424* (2013.01); *B05B 15/40* (2018.02); *B05B 15/68* (2018.02); *B08B 3/003* (2013.01); *B08B 3/026* (2013.01); *B01F 2005/044* (2013.01); *B01F 2005/0435* (2013.01); *B01F 2005/0445* (2013.01); *B01F 2215/0077* (2013.01)

(58) Field of Classification Search

CPC ..... B05B 1/26; B05B 7/025; B05B 7/0425; B01F 3/04446; B01F 5/0411; B01F 5/043; B01F 5/0496; B01F 2005/044; B01F 2005/0445; B01F 2215/0077; B01F 2005/0435; B08B 3/003; B08B 3/026

USPC ..... 239/310, 316, 318

See application file for complete search history.

FOAM GENERATING DEVICE FOR A HIGH-PRESSURE WATER GUN

CROSS REFERENCE TO RELATED APPLICATIONS

The present application is a U.S. National Phase of International Patent Application PCT/IB2015/056981, filed on Sep. 11, 2015, which claims priority to Italian Application No. TO2014A000714, filed on Sep. 11, 2014, each of which is incorporated by reference as if expressly set forth in their respective entireties herein.

TECHNICAL FIELD

The present invention relates to a foam generating device for a high pressure water gun.

BACKGROUND ART

Devices are known having a main inlet suitable to be attached to a water gun to receive a stream of water at high pressure and a secondary lower inlet, suitable to be connected to a container of cleansing liquid. The high-pressure water, once inside the device, flows towards the outlet through a conduit. A vacuum generated by the Venturi effect in this conduit causes the aspiration of a certain amount of cleansing liquid from the container. The cleansing liquid aspirated is automatically mixed with the water and thus forms a foam which is sprayed by the device through the outlet.

The solutions on the market normally have an adjustment system which is manually operated to obtain a spray in the form of a fan-like jet or solid stream jet.

Other solutions, such as the one shown in the patent EP1852190, end with a nozzle which forms a fan-shaped jet and which can rotate by a predetermined angle about the outlet direction of the jet, to change its orientation.

The need is felt to integrate into a single device an adjustment system to vary the type of jet and a system which can rotate the orientation of the fan-like jet.

DISCLOSURE OF INVENTION

The purpose of the present invention is to make a foam generating device for a high-pressure water gun, which makes it possible to simply and inexpensively satisfy the requirement set out above.

According to the present invention a foam generating device for a high pressure water gun, as defined in claim 1, is provided.

BRIEF DESCRIPTION OF THE DRAWINGS

The invention will now be described with reference to the accompanying drawings, which illustrate a non-limiting embodiment thereof, in which.

BEST MODE FOR CARRYING OUT THE INVENTION

Figure 1:
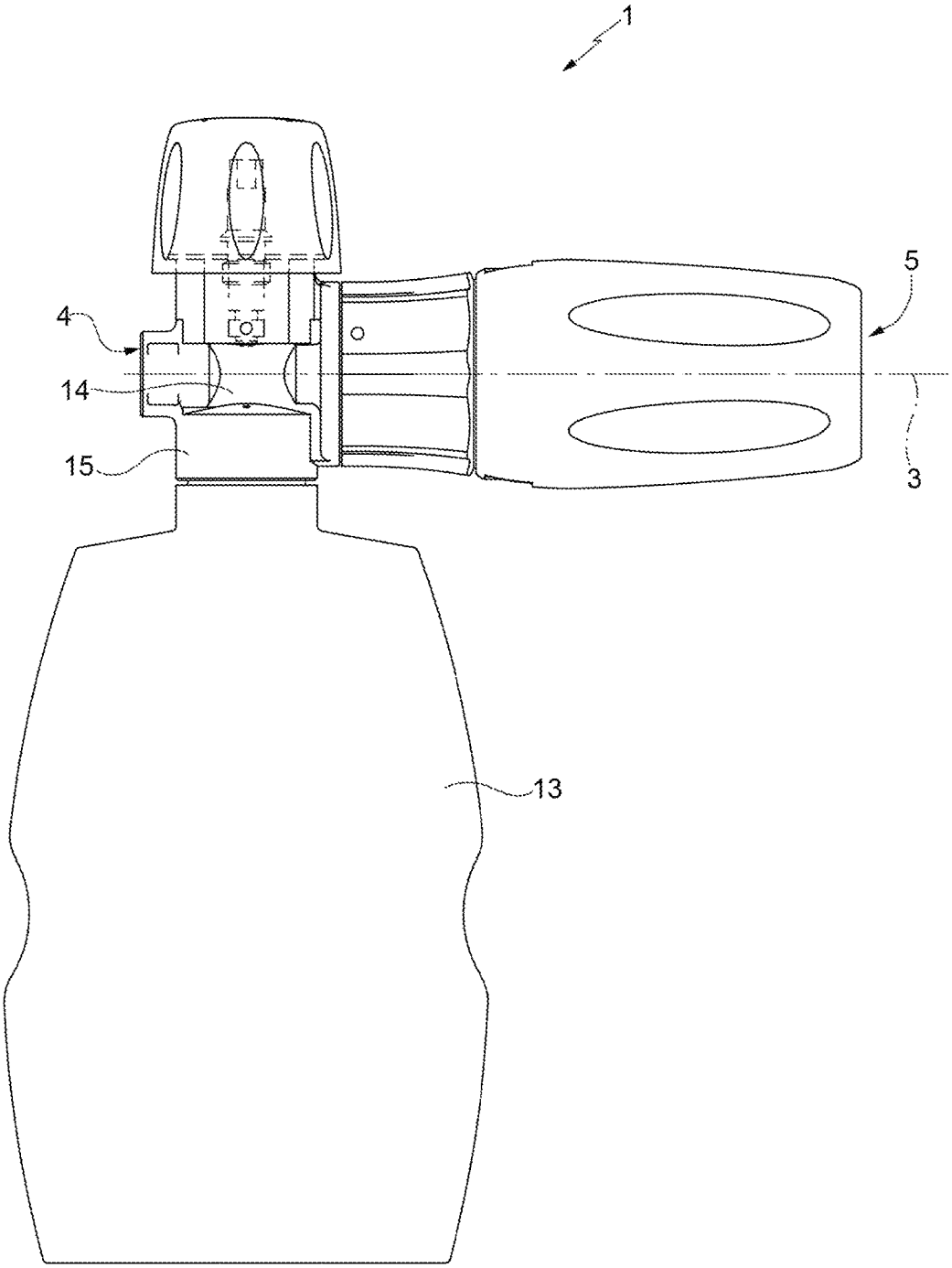
FIG. 1 illustrates, in a side view, a preferred embodiment of the foam generating device for a high-pressure water gun according to the present invention.

In the appended drawings, reference numeral 1 denotes a foam generating device having a conduit 2, which extends along an axis 3 from an inlet mouth 4 to an outlet 5. The inlet mouth 4 is suitable to be connected in a watertight manner to a high pressure water gun (not shown), directly or via a hose.

Figure 2:
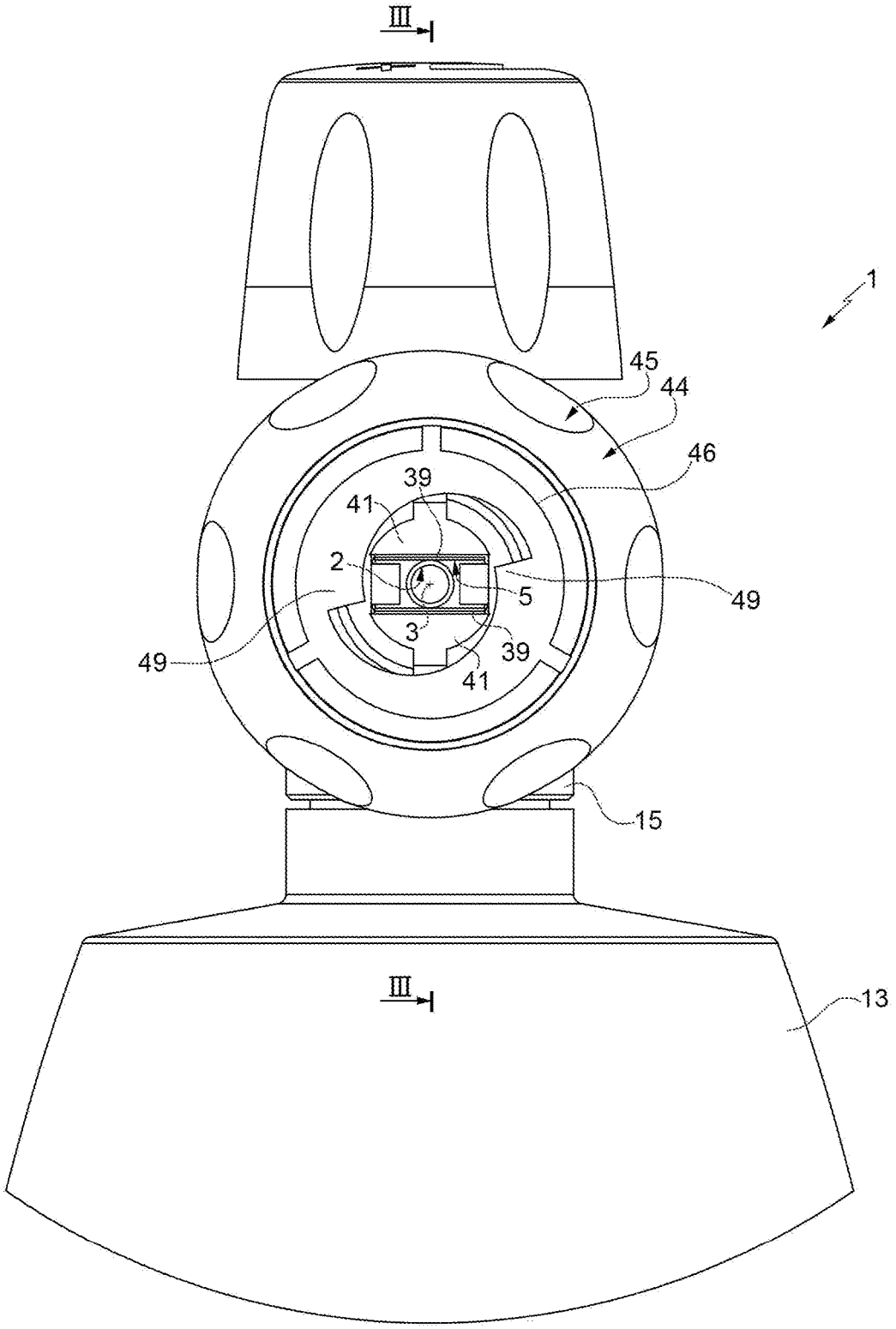
FIG. 2 is a front view, in enlarged scale, of the device in FIG. 1.
Figure 3:
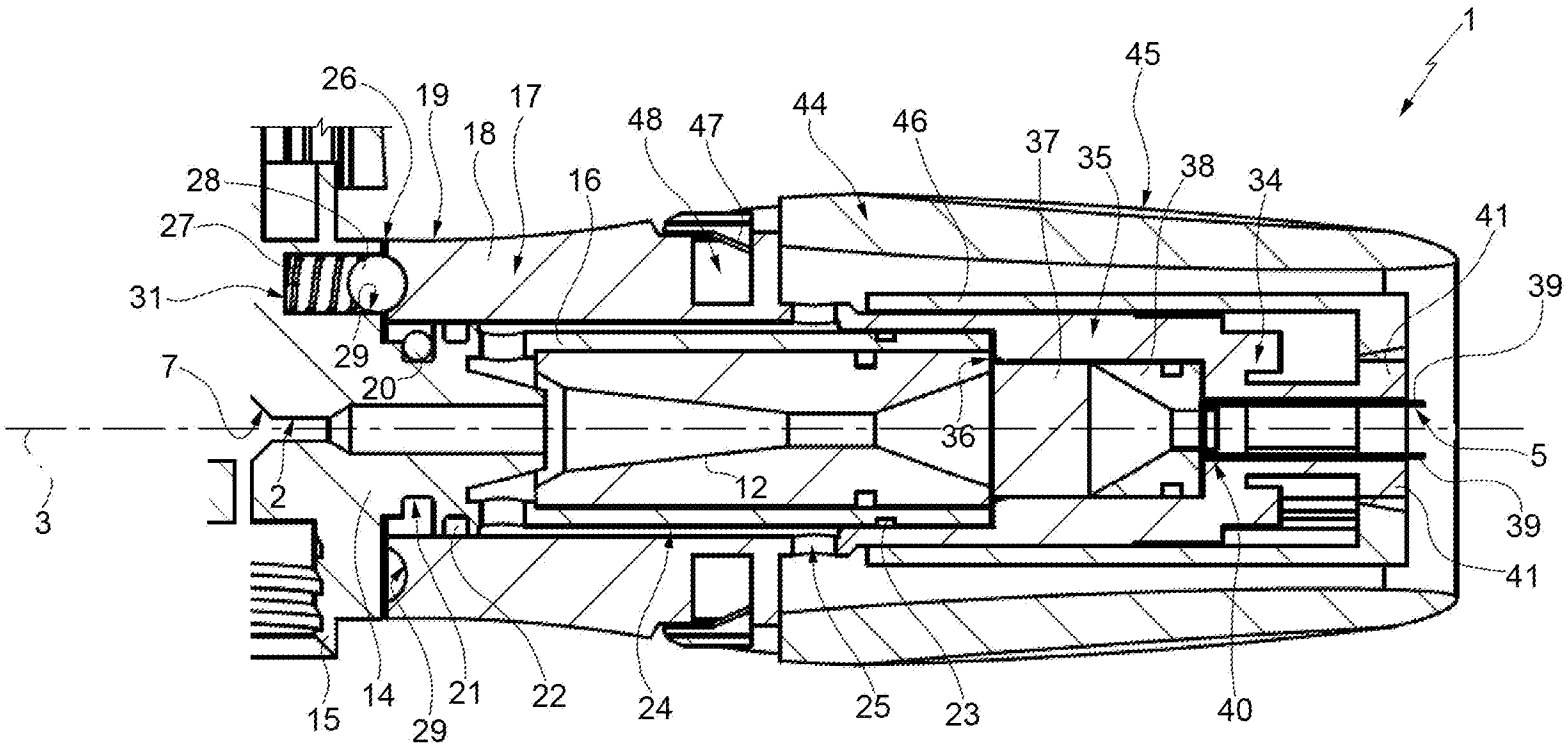
FIG. 3 is a cross-section view according to the cross-section plane III-III in FIG. 2.

With reference to FIG. 3, the conduit 2 comprises a mixing chamber 7, which, through a secondary lower inlet, communicates permanently with a container 13 (FIGS. 1 and 2) containing a cleansing liquid or other liquid foaming agent. Downstream of the mixing chamber 7, the conduit 2 has a Venturi tube 12, which creates a vacuum by means of the Venturi effect so as to aspirate liquid from the container 13 into the mixing chamber 7.

The inlet mouth 4, the mixing chamber 7 and lower inlet are made in a supporting body or valve body 14, which has a collar 15, defining a connection element for attaching the collar 13 of the container in a water-tight manner. The supporting body 14 is preferably made of metal and ends axially, towards the outlet 5, with a tubular protrusion 16, which preferably houses the Venturi tube 12.

The device 1 comprises a first movable body, defined by a sleeve 17, which is preferably made of plastic, coaxial to the conduit 2 and comprises a rear end portion 18 fitted around the tubular protrusion 16 so as not to be subject to the pressure of the fluid flowing in the conduit 2. The portion 18 is axially fixed and rotates about the axis 3 in relation to the supporting body 14 and has an outer surface 19 operable manually to rotate the sleeve 17. In particular, the sleeve 17 is kept in a fixed axial position by a tangential pin 20, which engages a circular slot 21 made in the supporting body 14.

Preferably, the Venturi tube 12 is defined by an insert, which is separate from the supporting body 14 and from the sleeve 17 and is axially inserted in the protrusion 16.

Advantageously, two sealing rings 22, 23 are arranged between the protrusion 16 and the inner surface of the sleeve 17 to ensure water-tightness. In an axial intermediate position between the rings 22 and 23, the outer surface of the protrusion 16 and the inner surface of the sleeve 17 together define a meatus 24, which is part of a passage 25 placing the external environment (at atmospheric pressure) in communication with a point of the conduit 2 immediately upstream of the Venturi tube, 12, in order to aerate the mixture formed of water and of the liquid aspirated from the container 13 and thus generate foam.

The device 1 further comprises a retention and positioning system 26 placed between the supporting body 14 and the portion 18 so as to define at least two reference positions of the sleeve 17, rotated by 90° relative to each other about the axis 3.

Preferably, the system 26 comprises an elastic element 27 and a stop element 28, which are carried by one of the portion 18 and the supporting body 14. The system 26 further comprises for each reference position, a corresponding retaining seat 29 made in the other of the portion 18 and the supporting body 14. The retaining seats 29 are arranged along a circumference about the axis 3.

The stop element 28 is movable and is pushed by the elastic element 27 towards the retaining seats 29. When one of said retaining seats 29 is engaged by the stop element 28, the sleeve 17 is angularly fixed in relation to the supporting body 14. When the torque acting on the outer surface 19 exceeds a certain threshold, defined by the load of the elastic element, the stop element 27 overcomes said load, moves rearwards and thus disengages the retaining seat 29. If the sleeve 17 continues to be turned, the stop element 28 will engage a retaining seat 29 which follows along the circumference and will thus stop the sleeve 17 in the corresponding reference position.

The stop element 28 is defined specifically by a ball and advantageously is movable in a direction parallel to the axis 3 in a guiding seat 31, which is made in the supporting body 14 and houses a coil spring, defining the elastic element 27.

Preferably, there are four of said retaining seats 29 equally distanced from one another about the axis 3.

Still with reference to FIG. 3, the sleeve 17 further comprises a front end portion 34 and an intermediate portion 35, which has a rear shoulder 36 resting axially against the Venturi tube 12 to retain the latter in a fixed axial position inside the protrusion 16. The portion 35 houses a filter 37 and a fitting 38, arranged in a pack, in fixed axial positions between the Venturi tube 12 and the portion 34.

The portion 34 supports two thin plates 39, which are preferably made of metal and are preferably parallel to each other and to the axis 3, when not deformed. In particular, the thin plates 39 are part of a fork 40 having an intermediate portion which is orthogonal to the axis 3 and is perforated to allow the transit of foam coming out of the fitting 38.

The fork 40 defines a nozzle which delimits the outlet 5 of the conduit 2 and is adjustable to vary the type of outgoing flow from a fan-like jet to a solid stream jet, in that the thin plates 39 are elastically flexible in a radial direction and, therefore, their front ends can be moved towards each other to vary the amplitude of the outlet 5.

The fork 40 is placed between two tabs 41 defining the front end of the portion 34. The tabs 41 are defined by axial projections which are elastically flexible in the radial direction to lean against the outer surface of the thin plates 39 and tighten the thin plates 39 against each other.

The device 1 further comprises a second movable body, defined by a sleeve 44, which is to coaxial to the conduit 2, coupled to the sleeve 17 in a fixed axial position and in a revolving manner and comprises an outer tubular portion 45 defining a manually operated knob to achieve the rotation of the sleeve 44 in relation to the sleeve 17. In particular, the sleeve 44 is made of plastic and comprises: an inner tubular portion 46 fitted onto the portion 35 and joined to the portion 45 by means of a plurality of radial spokes; and a plurality of posterior teeth 47, which are carried by the portion 45 and are snap-coupled in a circular groove 48 of the portion 18. As a result, the teeth 47 can slide in a circumferential direction, but are retained in a fixed axial position by a shoulder of the groove 48.

As shown in FIG. 2, at the front end the portion 46 comprises two cams 49, which face in a radial direction to the outer surface of the tabs 41 and are shaped (e.g. spirally) so as to lean against the tabs 41 and force them towards each other when the sleeve 44 is rotated about the axis 3 in relation to the sleeve 17.

When the front ends of the thin plates 39 are moved together by rotating the sleeve 44 (in a clockwise direction in FIG. 2), the outlet 5 narrows and thus the jet assumes a fan shape. By turning the sleeve 44 in the opposite direction, the ends of the thin plates 39 move apart again thanks to the elastic properties of the material, to a point where they do not intervene substantially on the jet, which therefore assumes a solid stream shape.

When the sleeve 17 is rotated in relation to the supporting body 14, the sleeve 44 rotates together with the sleeve 17, so that an adjustment of the orientation of the plane of the fan-shaped jet is obtained about the axis 3 in relation to the supporting body 14, without changing the relative position of the thin plates 39. In particular, the adjustment of the orientation of the fan-shaped jet, takes place between four reference positions at 90° relative to each other and defined by the retaining seats 29, as above.

From the above it is clear how the device 1 integrates the ability to vary the type of outgoing flow between a fan-shaped jet and a solid stream jet, thanks to the sleeve 44, and the ability to change the orientation of the fan-shaped jet, thanks to the sleeve 17.

Moreover, the device 1 is relatively simple and compact and has a relatively low number of components.

Even the assembly of the device 1 is relatively simple, consisting of fitting the sleeve 17 on the protrusion 16 after placing the elements of the system 26 between the supporting body 14 and said sleeve 17; blocking the latter by means of the pin 20; and lastly fitting the sleeve 44 onto the sleeve 17 as far as snapping the teeth 47 into the groove 48.

Moreover, the positioning defined by the system 26 is substantially free of annoying clearance, and is relatively simple to unlock.

From the above, lastly, it appears evident that modifications and variations may be made to the device 1 described with reference to the appended drawings while remaining within the sphere of protection of the present invention as defined in the appended claims.

In particular, the expedients provided for coupling the sleeves 44 and 17 may be different from those described above for example; and/or the shapes and/or the size of the various components may be different from those shown in the appended drawings.

The invention claimed is:

1. A foam generating device for a high-pressure water gun, the device comprising:

a supporting body;

a conduit extending along an axis from a main inlet to an outlet and comprising a mixing chamber communicating with a secondary inlet and subject, in use, to a vacuum for aspirating a liquid through said secondary inlet;

a nozzle defining said outlet and adjustable so as to vary the outgoing flow type between a fan-shaped jet and a solid stream jet;

characterised by further comprising:

a first body, fitted around one end of said supporting body, positioned in a fixed axial position and rotatable about said axis in relation to said supporting body; said nozzle being arranged at an end portion of said first body and in fixed angular position with respect to said first body;

a second body coupled to said first body in a fixed axial position and in rotating manner about said axis and comprising adjustment means for adjusting said nozzle in response to a rotation of said second body with respect to said first body;

said adjustment means comprise at least one cam;

said nozzle comprises two plates, which radially face each other and are elastically flexible in a radial direction towards each other in response to the action of said cam.

2. A device according to claim 1, characterised by comprising retaining and positioning means arranged between said supporting body and said first body and configured so as to define at least two angular reference positions of said first body.

3. A device according to claim 2, characterised in that said retaining and positioning means comprise:

at least one elastic element and a stop element, which are carried by one of said first body and supporting body; and for each said reference position, a corresponding retaining seat made in the other of said first body and supporting body;

said retaining seats being arranged along a circumference about said axis; said stop element being movable and being pushed by said elastic element so as to engage said retaining seats in a selective manner.

4. A device according to claim 3, characterised in that said stop element is defined by a ball.

5. A device according to claim 3, characterised in that said stop element is movable along a direction parallel to said axis in a corresponding guiding seat.

6. A device according to claim 5, characterised in that said elastic element is defined by a helical spring housed in the said guiding seat.

7. A device according to claim 3, characterised in that there are four of said retaining seats equally distanced from one another about said axis.

8. A device according to claim 1, characterised in that said second body comprises at least one elastically deformable tooth snap-coupled to said first body.

9. A device according to claim 1, characterised in that said first and second body are defined by respective sleeves coaxial to said conduit.

10. A foam generating device for a high-pressure water gun, the device comprising:

a supporting body;

a conduit extending along an axis from a main inlet to an outlet and comprising a mixing chamber communicating with a secondary inlet and subject, in use, to a vacuum for aspirating a liquid through said secondary inlet;

a nozzle defining said outlet and adjustable so as to vary the outgoing flow type between a fan shaped jet and a solid stream jet;

characterised by further comprising:

a first body, fitted around one end of said supporting body, positioned in a fixed axial position and rotatable about said axis in relation to said supporting body; said nozzle being arranged at an end portion of said first body and in fixed angular position with respect to said first body;

a second body coupled to said first body in a fixed axial position and in rotating manner about said axis and comprising adjustment means for adjusting said nozzle in response to a rotation of said second body with respect to said first body;

wherein said main inlet and said secondary inlet are both provided at said supporting body such that each of said first body and said second body is rotatable with respect to both said main inlet and said secondary inlet.

11. A device according to claim 10, characterised by comprising retaining and positioning means arranged between said supporting body and said first body and configured so as to define at least two angular reference positions of said first body.

12. A device according to claim 11, characterised in that said retaining and positioning means comprise:

at least one elastic element and a stop element, which are carried by one of said first body and supporting body; and for each said reference position, a corresponding retaining seat made in the other of said first body and supporting body;

said retaining seats being arranged along a circumference about said axis; said stop element being movable and being pushed by said elastic element so as to engage said retaining seats in a selective manner.

13. A device according to claim 12, characterised in that said stop element is defined by a ball.

14. A device according to claim 12, characterised in that said stop element is movable along a direction parallel to said axis in a corresponding guiding seat.

15. A device according to claim 14, characterised in that said elastic element is defined by a helical spring housed in the said guiding seat.

16. A device according to claim 12, characterised in that there are four of said retaining seats equally distanced from one another about said axis.

17. A device according to claim 10, characterised in that said second body comprises at least one elastically deformable tooth snap-coupled to said first body.

18. A device according to claim 10, characterised in that said first and second body are defined by respective sleeves coaxial to said conduit.

* * * * *